US010702907B2

(12) United States Patent
Lathrop

(10) Patent No.: US 10,702,907 B2
(45) Date of Patent: Jul. 7, 2020

(54) WORK PIECE POSITIONING APPARATUS

(71) Applicant: THE BOEING COMPANY, Chicago, IL (US)

(72) Inventor: Mathew Keller Lathrop, Puyallup, WA (US)

(73) Assignee: THE BOEING COMPANY, Chicago, IL (US)

( * ) Notice: Subject to any disclaimer, the term of this patent is extended or adjusted under 35 U.S.C. 154(b) by 293 days.

(21) Appl. No.: 15/881,868

(22) Filed: Jan. 29, 2018

(65) Prior Publication Data

US 2019/0232356 A1 Aug. 1, 2019

(51) Int. Cl.
*B21D 43/00* (2006.01)
*B21D 53/92* (2006.01)

(52) U.S. Cl.
CPC ..... *B21D 43/003* (2013.01); *B21D 53/92* (2013.01)

(58) Field of Classification Search
None
See application file for complete search history.

(56) References Cited

U.S. PATENT DOCUMENTS 5,527,014 A * 6/1996 Bracewell ..... B66F 19/00 254/15
6,616,132 B1 * 9/2003 Ellison ..... E04F 21/22 269/15
8,434,738 B1 * 5/2013 Anstett ..... E04F 21/22 254/11
2011/0138737 A1 * 6/2011 Edgerly ..... E04F 21/22 52/745.05

* cited by examiner

*Primary Examiner* — Brian D Keller
(74) *Attorney, Agent, or Firm* — The Small Patent Law Group LLC; Joseph M. Butscher

(57) ABSTRACT

A positioning apparatus for aligning a work piece with a forming machine includes a base, a pusher rod, a clevis pin, and a handle. The base includes a frame and a stand that has a claw portion that receives an edge of the work piece. The pusher rod protrudes through an aperture of the frame and is mechanically coupled to the clevis pin. The handle has a clevis end mechanically coupled to the clevis pin. The handle is pivotally coupled to the frame via a pivot axle. When a distal end of the pusher rod engages a contact surface of the forming machine, an input force applied to the handle causes rotation of the handle about the clevis pin and exertion of an output force on the frame via the pivot axle. The output force moves the base and the work piece away from the contact surface.

21 Claims, 6 Drawing Sheets

WORK PIECE POSITIONING APPARATUS

FIELD OF EMBODIMENTS OF THE DISCLOSURE

Embodiments of the present disclosure generally relate to a positioning apparatus and method for aligning a work piece with a forming machine for use in manufacturing, such as aircraft manufacturing.

BACKGROUND OF THE DISCLOSURE

In manufacturing, machinery is used to form and/or cut flat work pieces into designated shapes for various applications. For example, during the manufacturing of an aircraft, forming machines may be used to produce spars from flat work pieces. Spars are load-bearing structural members that are located within the wings and the empennage of the aircraft, such as in the horizontal and vertical stabilizers at the tail of the aircraft. The spars may be attached to other structural members, such as ribs, to define structural frames, and the frames may be subsequently covered by a skin of the aircraft. Spars may be composed of various different materials, such as wood and metal, but it is common today to form spars out of laminated composite materials, such as carbon fiber.

Some known machines for cutting and forming spars out of laminated composite materials are oriented about a platform or table that receives a flat laminate work piece thereon. The flat work piece, sometimes referred to as a "spar charge" may weigh between 50 and 100 pounds, if not more. A flange portion of the work piece extends beyond an edge of the platform and aligns with the machine. The machine heats the overhanging flange portion and applies pressure and mechanical force to gradually form the work piece into a designated curved or contoured shape for the spar.

Dimensions of the finished spar typically must meet strict specifications to be installed within an aircraft. The dimensions of the finished spar depend on accurate alignment of the flat work piece relative to the machine. Certain known forming machines may include a pulling device that pulls the flat work piece towards the machine and bumpers that guide the movement of the flat work piece. The bumpers may be unreliable, so the work pieces may become misaligned as the work pieces are pulled into the machine. In order to straighten or realign the work piece, an operator may manually lift and pull the work piece. Such manual action may be difficult and/or uncomfortable to accomplish due to the relatively heavy weight of the work piece and/or awkward body posture adopted to access and lift the work piece.

Accordingly, known machines for forming work pieces in manufacturing, such as for forming laminate spars for aircrafts, may have unreliable and inaccurate guidance members, requiring manual intervention to lift and reposition the heavy work pieces relative to the machines.

SUMMARY OF THE DISCLOSURE

Certain embodiments of the present disclosure provide a positioning apparatus for aligning a work piece with a forming machine. The positioning apparatus includes a base, a pusher rod, a clevis pin, and a handle. The base includes a stand and a frame that extends from the stand. The stand has a claw portion configured to receive an edge of the work piece. The frame defines an aperture. The pusher rod protrudes through the aperture of the frame. The pusher rod has a proximal end within the frame and a distal end outside of the frame. The clevis pin is mechanically coupled to the proximal end of the pusher rod. The clevis pin has a first end segment and a second end segment that extend through corresponding first and second slots within the frame. The handle has a clevis end and a contact end opposite the clevis end. The clevis end is mechanically coupled to the clevis pin and pivotable relative to the clevis pin. The handle is pivotally coupled to the frame via a pivot axle that is spaced apart from the clevis pin. When the handle is rotated about the pivot axle such that the distal end of the pusher rod extends and engages a contact surface of the forming machine, an input force applied to the contact end of the handle causes rotation of the handle about the clevis pin and exertion of an output force on the frame via the pivot axle. The output force moves the base and the work piece within the claw portion in a rearward direction away from the contact surface.

Certain embodiments of the present disclosure provide a positioning apparatus for aligning a work piece with a forming machine. The positioning apparatus includes a base, a pusher rod, and a handle. The base has a claw portion configured to receive an edge of the work piece. The pusher rod is held on the base and is translatable relative to the base along an extension axis that is spaced apart from the claw portion of the base. The handle has a clevis end and a contact end opposite the clevis end. The clevis end is mechanically coupled to the pusher rod via a clevis pin. The handle is pivotally coupled to the base via a pivot axle that is spaced apart from the clevis pin. When a distal end of the pusher rod engages a contact surface of the forming machine, an input force applied to the contact end of the handle causes rotation of the handle about the clevis pin and exertion of an output force on the base via the pivot axle. The output force on the base moves the claw portion and the work piece therein in a rearward direction away from the contact surface to align the work piece relative to the forming machine.

Certain embodiments of the present disclosure provide a method for aligning a work piece relative to a forming machine. The method includes placing a positioning apparatus on the work piece that is disposed on the forming machine such that an edge of the work piece is received within a claw portion of a base of the positioning apparatus. The method also includes rotating a handle of the positioning apparatus along a first arc length to cause a pusher rod of the positioning apparatus to move relative to the base towards a contact surface of the forming machine until a distal end of the pusher rod engages the contact surface. The handle is pivotally coupled to the base via a pivot axle and rotates about the pivot axle along the first arc length. The handle has a clevis end mechanically coupled to the pusher rod via a clevis pin that is spaced apart from the pivot axle. The method also includes applying an input force to rotate the handle beyond the first arc length causing the handle to rotate about the clevis pin and an output force to be exerted on the base via the pivot axle. The output force moves the base and the work piece within the claw portion in a rearward direction away from the contact surface of the forming machine.

DETAILED DESCRIPTION OF THE DISCLOSURE

Certain embodiments of the present disclosure include a positioning apparatus that is configured to aid an operator with positioning a work piece relative to a forming machine. The positioning apparatus may be a device or tool that engages the work piece and a stationary surface, such as a surface of the forming machine. The positioning apparatus uses the stationary surface as leverage to mechanically pry the work piece in a direction away from the stationary surface.

Compared to known forming machines that may include unreliable guidance mechanisms, such as bumpers, and typically require an operator to manually drag the work piece into a designated alignment position, the positioning apparatus according to the embodiments described herein uses a lever mechanism to provide a mechanical advantage. The mechanical advantage provided by the positioning apparatus reduces the manual force required to reposition a work piece. Furthermore, the positioning apparatus is operated by grasping a handle of the positioning apparatus and pulling (or pushing) the handle to pivot the handle, causing an output force that pushes the positioning apparatus away from the stationary surface. The action of pivoting a handle to move a work piece may be more ergonomic and comfortable than lifting and dragging the work piece by hand. Additionally, the use of the positioning apparatus for positioning the work piece may allow for more precise and consistent alignment of the work piece in a designated alignment position than is consistently achievable via known guidance mechanisms on the forming machines or pure manual positioning of the work piece. The use of the positioning apparatus during manufacturing may increase the output of formed work pieces that meet designated standards or specifications relative to not using the positioning apparatus, as aligning the work pieces with the positioning apparatus may be more efficient than pure manual alignment and/or may produce fewer formed work pieces that fail to meet the designated standards or specifications.

Figure 1:
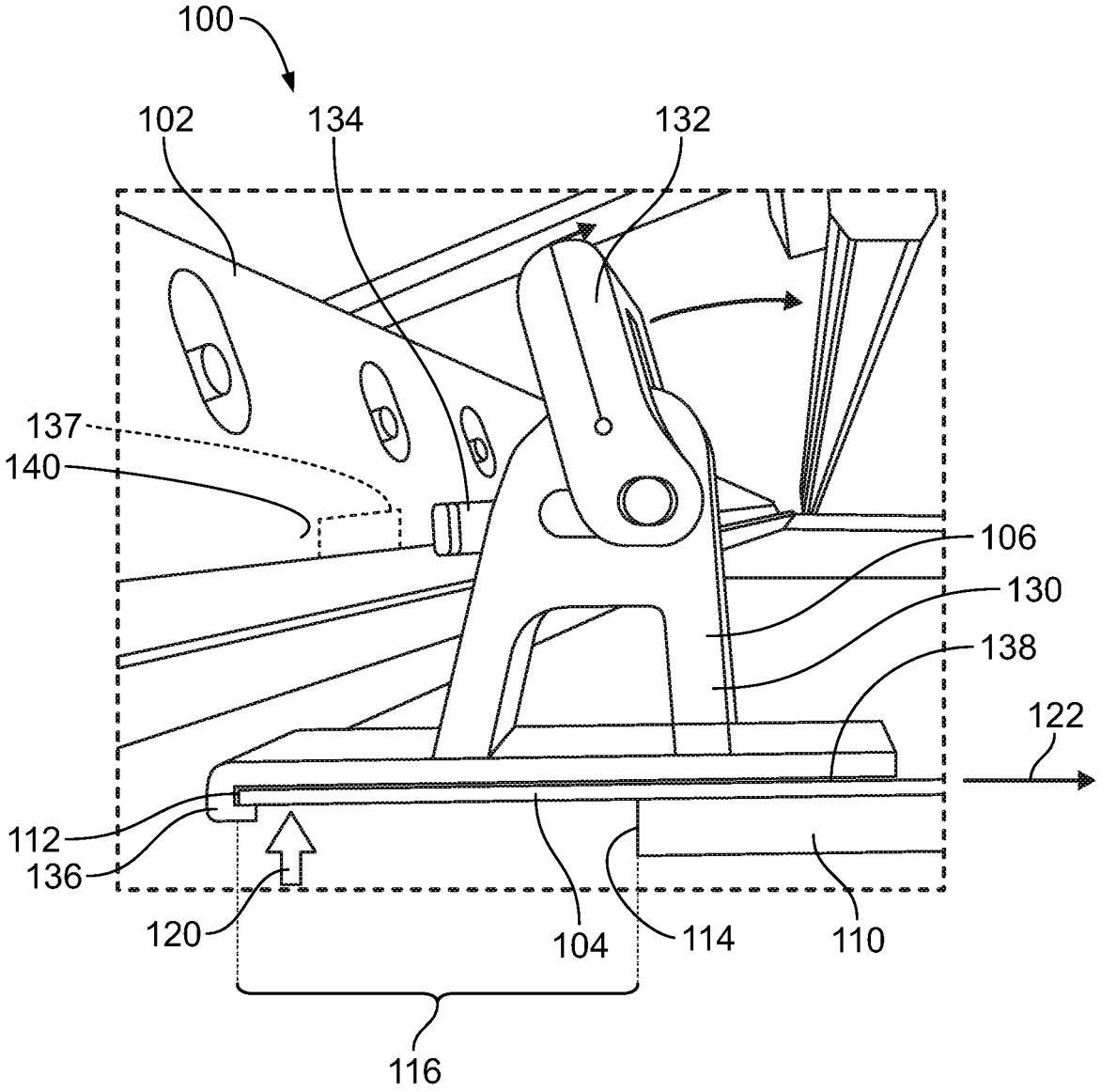
FIG. 1 illustrates a manufacturing system according to an embodiment of the present disclosure that includes a forming machine, a work piece, and a positioning apparatus.

FIG. 1 illustrates a manufacturing system 100 according to an embodiment of the present disclosure. The manufacturing system 100 includes a forming machine 102, a work piece 104, and a positioning apparatus 106. The forming machine 102 is configured to form the work piece 104 into a designated shape. The forming machine 102 may also cut the work piece 104. The positioning apparatus 106 is configured to aid with aligning the work piece 104 relative to the forming machine 102 to enable accurate and precise forming of the work piece 104 by the forming machine 102.

The work piece 104 may have a thin, planar structure. In one or more embodiments, the work piece 104 may be a laminate spar (or spar charge) that gets heated and formed by the forming machine 102 into a curved or contoured shape to define an aircraft spar. The aircraft spar, once formed, may be assembled with other spars within a wing or a tail fin (e.g., a vertical stabilizer or a horizontal stabilizer) of a new aircraft to provide structural support. In a different embodiment, the forming machine 102 may be configured to form the work piece 104 into a different component for an aircraft, such as a rib that is coupled to one or more spars as part of a support frame of a wing or tail fin. Furthermore, it is recognized that the positioning apparatus 106 may be used for positioning work pieces that are formed into various different components for various applications other than aircraft assembly. For example, in another embodiment, the positioning apparatus 106 may be used for positioning work pieces that are formed into components of automobiles, buildings, or the like.

In the illustrated embodiment, the work piece 104 is disposed on top of a table or platform 110. The work piece 104 has an edge 112 that projects beyond an edge 114 of the table 110 such that a flange section 116 of the work piece 104 overhangs the table 110. The flange section 116 gets formed by the forming machine 102. For example, the forming machine 102 may be a shear forming machine 102 that shapes and optionally also cuts the flange section 116 of the work piece 104. The forming machine 102 may be configured to shape and form the flange section 116 by heating the flange section 116 and subsequently forcing the flange section 116 against a contoured shaping component, such as an inflatable hose.

In order for the forming machine 102 to produce an accurate and repeatable formed product or component, the work piece 104 is positioned in a designated alignment position relative to the forming machine 102. When the work piece 104 is in the designated alignment position, the work piece 104 is both positionally (e.g., in the X and Y axes) and angularly aligned with the forming machine 102. The location of the designated alignment position relative to the forming machine 102 may depend on the specific forming machine 102. In FIG. 1, the arrow marker 120 illustrated below the flange section 116 indicates where the edge 112 of the work piece 104 should be located to achieve the designated alignment position. Although not shown in FIG. 1, the table 110 and/or the forming machine 102 may have alignment markers that indicate the designated alignment position for the work piece 104. In the illustrated position of the work piece 104, the edge 112 is not aligned with the marker 120. The arrow marker 120 is disposed between the edge 112 and the table 110. The work piece 104 should be moved in a rearward direction 122 away from the forming machine 102 (such that the edge 112 moves towards the edge 114 of the table 110) to achieve the designated alignment position. The positioning apparatus 106 may be used by an operator to move the work piece 104 in the rearward direction 122 until the edge 112 aligns with the marker 120.

The positioning apparatus 106 includes a base 130, a handle 132, and a pusher rod 134. The handle 132 and the pusher rod 134 are held on the base 130 and are movable relative to the base 130. The positioning apparatus 106 is placed on a top surface 138 of the work piece 104 and extends along the flange section 116 to the edge 112 of the work piece 104. The base 130 has a claw portion 136 that extends downward and engages the edge 112 of the work piece 104.

The positioning apparatus 106 is configured to use the forming machine 102 as leverage for moving the work piece 104 in the rearward direction 122 relative to the table 110 and the forming machine 102. The pusher rod 134 is mechanically coupled to the handle 132 (directly or indirectly). The handle 132 is pivotally coupled to the base 130. The handle 132 is configured to be rotated or pivoted by an operator grasping the handle 132 and manually pushing or pulling the handle 132. As the handle 132 is rotated or pivoted relative to the base 130, the handle 132 forces the pusher rod 134 to extend towards and engage a contact surface 140 of the forming machine 102. The boundary 137 in FIG. 1 indicates the region of the contact surface 140 may be engaged by the pusher rod 134 when the handle 132 is rotated to extend the pusher rod 134 towards the forming machine 102. Additional rotation of the handle 132 while the pusher rod 134 is in engagement with the contact surface 140 creates a moment or torque that established a leverage force applied from the contact surface 140 through the pusher rod 134 and the handle 132 to the base 130. The leverage force causes the base 130 to move in the rearward direction 122 away from the contact surface 140. As the base 130 moves, the claw portion 136 of the base 130 engages the edge 112 of the work piece 104 and moves the work piece 104 with the base 130. Therefore, the positioning apparatus 106 operates to pry the work piece 104 away from the contact surface 140 of the forming machine 102, increasing the distance between the edge 112 and the contact surface 140.

The positioning apparatus 106 may be used to move and reposition work pieces 104 that are up to 100 pounds or more without requiring an operator to manually lift and drag or push the work piece 104 along the table 110. In an embodiment, the operator may cease rotation of the handle 132 in response to the operator noticing that the edge 112 of the work piece 104 aligns with the marker 120, or when additional rotation of the handle 132 is blocked by a hard stop feature on the positioning apparatus 106.

Although the positioning apparatus 106 is used to move the work piece 104 in the rearward direction 122, the positioning apparatus 106 can also be used to move the work piece 104 in other directions by placing the positioning apparatus 106 along other edges of the work piece 104. For example, if the work piece 104 should be moved towards the contact surface 140 of the forming machine 102 to achieve a designated alignment position, then the positioning apparatus 106 may be placed on an edge (not shown) of the work piece 104 that is opposite to the edge 112. Operation of the positioning apparatus 106 causes the pusher rod 134 to engage and generate leverage from another contact surface (not shown) of the forming machine 102, such as a contact surface across the table 110 from the contact surface 140, to pry the work piece 104 towards the contact surface 140.

Figure 2:
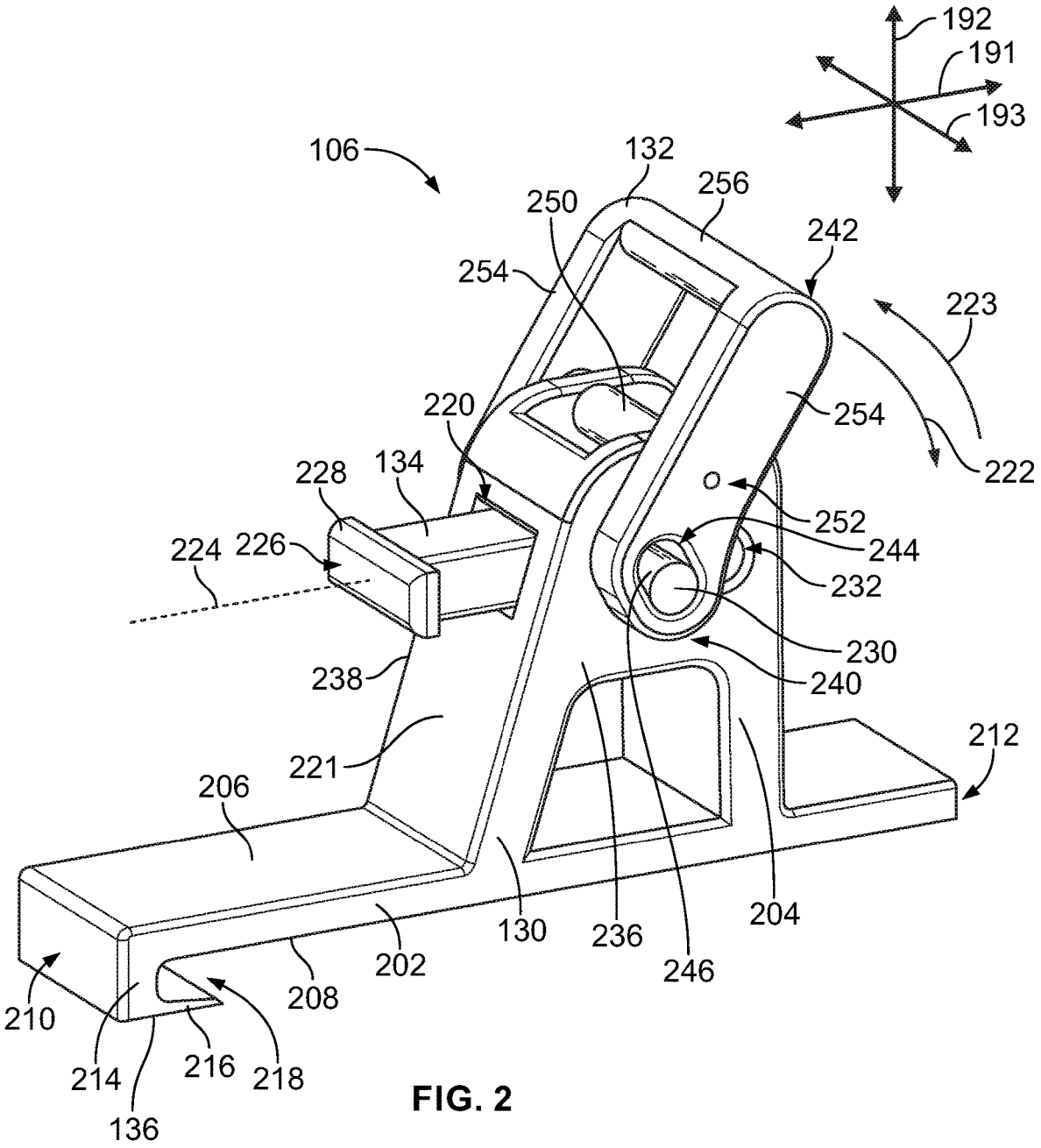
FIG. 2 is a perspective view of the positioning apparatus according to an embodiment of the present disclosure.

FIG. 2 is a perspective view of the positioning apparatus 106 according to an embodiment of the present disclosure. The positioning apparatus 106 is oriented with respect to a longitudinal or depth axis 191, a vertical axis 192, and a lateral axis 193. The axes 191-193 are mutually perpendicular. Although the vertical axis 192 appears to extend in a vertical direction parallel to gravity in FIG. 2, it is understood that the axes 191-193 are not required to have any particular orientation with respect to gravity.

In at least one embodiment, the base 130 includes a stand 202 and an upright portion or frame 204. The stand 202 is configured to sit on the work piece 104 (FIG. 1). The frame 204 extends from the stand 202. For example, the stand 202 has a top side 206 and a bottom side 208 that is opposite the top side 206. As used herein, relative or spatial terms such as "top," "bottom," "upper," "lower," "front," and "rear" are only used to distinguish the referenced elements of the positioning apparatus 106 and do not necessarily require particular positions or orientations relative to the surrounding environment of the positioning apparatus 106. The stand 202 may have a planar block shape between the top and bottom sides 206, 208. The frame 204 extends upward from the top side 206 of the stand 202. The frame 204 is a structural member that holds the pusher rod 134 and the handle 132 at designated heights above the stand 202.

The stand 202 defines the claw portion 136 of the base 130 that engages the edge 112 (FIG. 1) of the work piece 104. For example, the claw portion 136 extends downward beyond the bottom side 208 of the stand 202. The claw portion 136 is disposed at a first end 210 of the stand 202 in the illustrated embodiment, but in other embodiments the claw portion 136 may be spaced apart from the first end 210 (e.g., closer to a second end 212 of the stand 202 opposite the first end 210). The claw portion 136 has a shoulder segment 214 that extends downward from the bottom side 208 and a hook end 216 that extends from the shoulder segment 214 in a direction towards the second end 212 of the stand 202. The hook end 216 is spaced apart vertically from the bottom side 208 of the stand 202 such that a channel 218 is defined between the hook end 216 and the bottom side 208. When the positioning apparatus 106 is placed on a work piece 104, as shown in FIG. 1, the bottom side 208 is configured to abut the top surface 138 of the work piece 104. The positioning apparatus 106 may be slid in a longitudinal direction relative to the work piece 104 to receive the edge 112 of the work piece 104 into the channel 218 of the claw portion 136. When the edge 112 is within the channel 218, the positioning apparatus 106 is hooked onto the work piece 104.

The pusher rod 134 is held on the frame 204 of the base 130. The pusher rod 134 extends through an aperture 220 in the frame 204. The aperture 220 is located along a front side 221 of the frame 204 that faces towards the contact surface 140 of the forming machine 102 when the positioning apparatus 106 is hooked onto the work piece 104, as shown in FIG. 1. The pusher rod 134 is movable relative to the frame 204 based on rotation of the handle 132. For example, as the handle 132 is rotated in a first direction 222 about the frame 204, referred to herein as an actuation direction 222, the pusher rod 134 translates outward away from the frame 204 along an extension axis 224 such that an increased length of the pusher rod 134 projects outside of the aperture 220. When the handle 132 is rotated in an opposite direction 223 to the actuation direction 222, the pusher rod 134 retracts along the extension axis 224 into the frame 204 through the aperture 220. The extension axis 224 is spaced apart vertically from the stand 202 and the claw portion 136. The extension axis 224 may be parallel to the longitudinal axis 191 of the positioning apparatus 106. The extension axis 224 may be generally parallel (e.g., oriented at an angle that is within 3 degrees, 5 degrees, or 7 degrees) of an orientation of the planar bottom side 208 of the stand 202.

The pusher rod 134 has a distal end 226 outside of the frame 204 that is configured to engage the contact surface 140 of the forming machine 102. The distal end 226 of the pusher rod 134 may have an elongated stump 228 to increase the engagement area between the pusher rod 134 and the contact surface 140 of the forming machine 102. Although not shown, the stump 228 may include a padded or deformable material.

The pusher rod 134 is mechanically coupled to a clevis pin 230 within the frame 204. The clevis pin 230 is also coupled to the frame 204. For example, the clevis pin 230 extends through a first slot 232 and a second slot 234 (shown in FIG. 3) within the frame 204. The first slot 232 is disposed along a first side wall 236 of the frame 204, and the second slot 234 is disposed along a second side wall 238 of the frame 204 that is opposite the first side wall 236. In at least one embodiment, the positioning apparatus 106 is symmetric along a lateral centerline such that the first and second slots 232, 234 and the first and second side walls 236, 238 mirror each other across the lateral centerline. As the pusher rod 134 translates along the extension axis 224, the clevis pin 230 moves with the pusher rod 134. For example, the clevis pin 230 moves along the extension axis 224 within the first and second slots 232, 234 of the frame 204.

The handle 132 is mechanically coupled to the clevis pin 230, and is mechanically coupled to the pusher rod 134 via the clevis pin 230. For example, the handle 132 may be directly coupled to the clevis pin 230 and indirectly coupled to the pusher rod 134. The handle 132 is also pivotable relative to the clevis pin 230. The handle 132 has a clevis end 240 and a contact end 242 opposite the clevis end 240. The clevis end 240 of the handle 132 is mechanically coupled to the clevis pin 230 and pivots relative to the clevis pin 230. The contact end 242 is configured to be engaged (e.g., held or grasped) by an operator to operate the positioning apparatus 106. Optionally, an operator may also hold the contact end 242 of the handle 132 to carry the positioning apparatus 106.

The handle 132 may define oblong openings 244 at the clevis end 240. Only one oblong opening 244 is visible in FIG. 2. End segments 246 of the clevis pin 230 may extend in to the oblong openings 244 to mechanically couple the handle 132 to the clevis pin 230. For example, a first end segment 246 of the clevis pin 230 extends into the oblong opening 244 that is visible in FIG. 2, and a second end segment (not shown) of the clevis pin 230 extends into another oblong opening (not shown) on the handle 132 proximate to the second side wall 238 of the frame 204. Optionally, the oblong openings 244 have larger sizes (e.g., cross-sectional areas) than the sizes of the end segments 246 of the clevis pin 230 to define clearance spaces that allow the clevis pin 230 to translate relative to the handle 132 within the oblong openings 244 as the handle 132 rotates.

The handle 132 is pivotally coupled to the frame 204 via a pivot axle 250 that is spaced apart from the clevis pin 230. In an embodiment, the pivot axle 250 is oriented parallel to the clevis pin 230. For example, both the pivot axle 250 and the clevis pin 230 may be oriented parallel to the lateral axis 193. The pivot axle 250 may be located at an intermediate section 252 of the handle 132 between the clevis end 240 and the contact end 242. The handle 132 is configured to pivot or rotate about both the pivot axle 250 and the clevis pin 230 during operation of the positioning apparatus 106 to move the work piece 104 (FIG. 1) relative to the forming machine 102 (FIG. 1). For example, the handle 132 may rotate about the pivot axle 250 during initial movement of the handle 132 in the actuation direction 222, and the handle 132 may rotate about the clevis pin 230 during subsequent movement of the handle 132 in the actuation direction 222, as described in more detail herein.

In at least one embodiment, the handle 132 includes two arms 254 and a bar 256 that extends between the two arms 254 and mechanically couples to both of the arms 254. The bar 256 is located at the contact end 242 of the handle 132. For example, the operator may grasp the bar 256 to rotate the handle 132. The arms 254 may be mirror images of each other. The arms 254 may both extend from the clevis end 240 of the handle 132 to the contact end 242.

Figure 3:
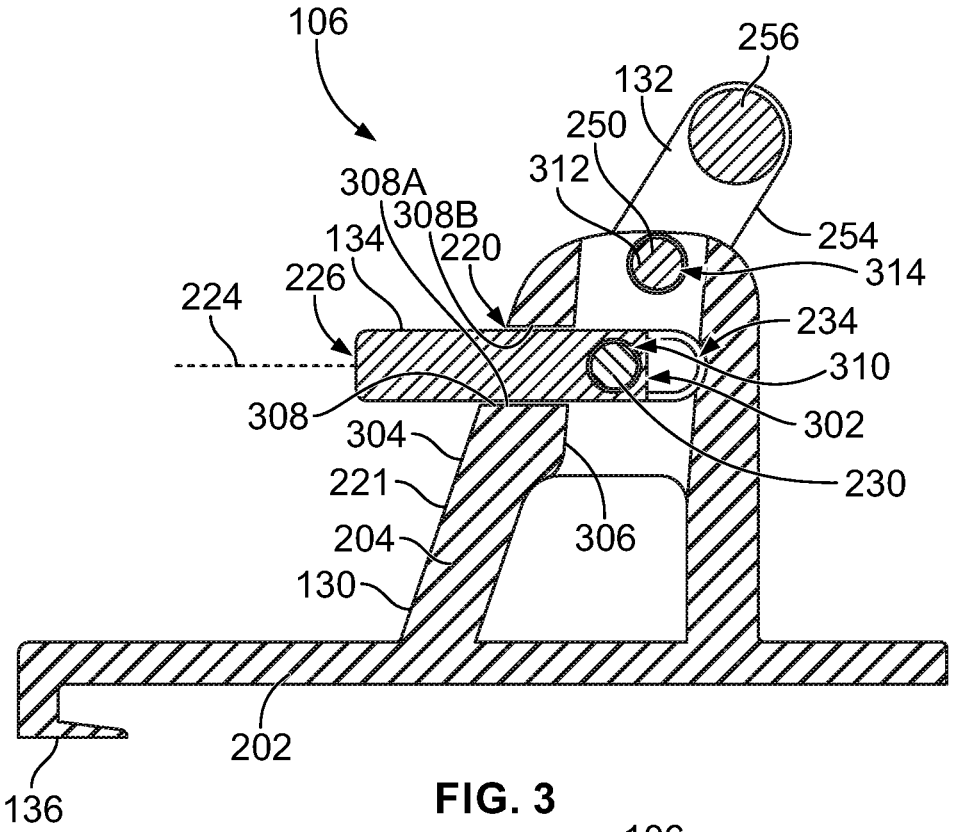
FIG. 3 is a transverse cross-sectional view of the positioning apparatus according to an embodiment of the present disclosure.

FIG. 3 is a transverse cross-sectional view of the positioning apparatus 106 according to an embodiment of the present disclosure. The cross-section bisects the positioning apparatus 106 at a midpoint along the lateral axis 193 shown in FIG. 2 between the first and second side walls 236, 238 (FIG. 2) of the frame 204. The cross-section line in the illustrated embodiment extends through the stand 202, the frame 204, the pusher rod 134, the bar 256 of the handle 132, the pivot axle 250, and the clevis pin 230.

The pusher rod 134 has proximal end 302 opposite the distal end 226. The proximal end 302 is disposed within the frame 204. The pusher rod 134 extends through the aperture 220 such that the distal end 226 is exterior of the aperture 220 and the proximal end 302 is interior of the aperture 220. In the illustrated embodiment, the aperture 220 has a depth that extends from an exterior surface 304 of the frame 204 at the front side 221 to an interior surface 306 of the frame 204 within the frame 204. The frame 204 includes interior walls 308 that define a perimeter of the aperture 220 along the depth of the aperture 220. One or more of the interior walls 308 may engage the pusher rod 134 and guide movement of the pusher rod 134 relative to the frame 204 as the handle 132 is rotated. For example, a lower interior wall 308A and an upper interior wall 308B may restrict vertical movement of the pusher rod 134 relative to the frame 204, guiding the pusher rod 134 to move longitudinally along the extension axis 224. Although not shown in FIG. 3, the interior walls 308 of the aperture 220 may include side walls that restrict lateral movement of the pusher rod 134 relative to the frame 204.

The clevis pin 230 is mechanically coupled to the proximal end 302 of the pusher rod 134. For example, in the illustrated embodiment, the clevis pin 230 extends laterally through a hole 310 the pusher rod 134 at the proximal end 302. In at least one other embodiment, the clevis pin 230 is integral to the pusher rod 134 such that the pusher rod 134 and the clevis pin 230 represent a unitary, monolithic structure. For example, the pusher rod 134 may be formed as one piece with the clevis pin 230 during a common formation process such that there are no seams between the components. The formation process may be a molding process or an additive manufacturing process (e.g., 3D printing). In another example, the pusher rod 134 may be welded or otherwise bonded to the clevis pin 230 via heat to form the unitary, monolithic structure. When the clevis pin 230 is integral to the pusher rod 134, the clevis pin 230 is not distinguishable from the pusher rod 134 in the cross-sectional view shown in FIG. 3. For example, the clevis pin 230 may be defined only by the end segments 246 that project laterally from the pusher rod 134 at the proximal end 302, like ears.

In at least one embodiment, the base 130 is a unitary, monolithic structure such that the frame 204 is integral with the stand 202. The claw portion 136 is included in the monolithic structure. As shown in FIG. 3, there are no seams at the interface between the stand 202 and the frame 204. In at least one other embodiment, the frame 204 may be discrete from the stand 202 and mounted to the stand 202 using a fastener, an adhesive, or the like.

As shown in FIG. 3, the pivot axle 250 is disposed vertically above the clevis pin 230. The pivot axle 250 is located between the clevis pin 230 and the bar 256 of the handle 132. The pivot axle 250 may be defined by various components in different embodiments. For example, in the illustrated embodiment, the pivot axle 250 is an integral component of the handle 132. The handle 132 has one or more posts 312 that extend from the arms 254 of the handle 132 through corresponding holes 314 in the frame 204. The one or more posts 312 represent the pivot axle 250. The one or more posts 312 may rotate within the holes 314 like bearings within journals to allow the handle 132 to rotate or pivot relative to the frame 204. Optionally, the handle 132 may include two posts 312, with one post 312 extending from each of the two arms 254. Alternatively, the handle 132 may include a single post 312 that extends fully between the two arms 254 and connects to both of the arms 254. In at least one other embodiment, the pivot axle 250 may be defined by posts (not shown) of the frame 204 that extend through holes (not shown) in the arms 254 of the handle 132. In another embodiment, the pivot axle 250 may be defined by a discrete cylindrical member that is discrete from the handle 132 and the frame 204, and the cylindrical member may be removably coupled to the arms 254 of the handle 132 through the holes 314 in the frame 204 using fasteners, spring-loaded tips, or the like.

The components of the positioning apparatus 106 (e.g., the base 130, the pusher rod 134, the handle 132, etc.) may be composed of one or more plastic materials, one or more metals, one or more composite materials, or the like. For example, in at least one embodiment, all of the components may be composed of one or more plastic materials. The positioning apparatus 106 may be formed and assembled simultaneously via additive manufacturing (e.g., 3D printing), or the components may be formed and then subsequently assembled.

Figure 4:
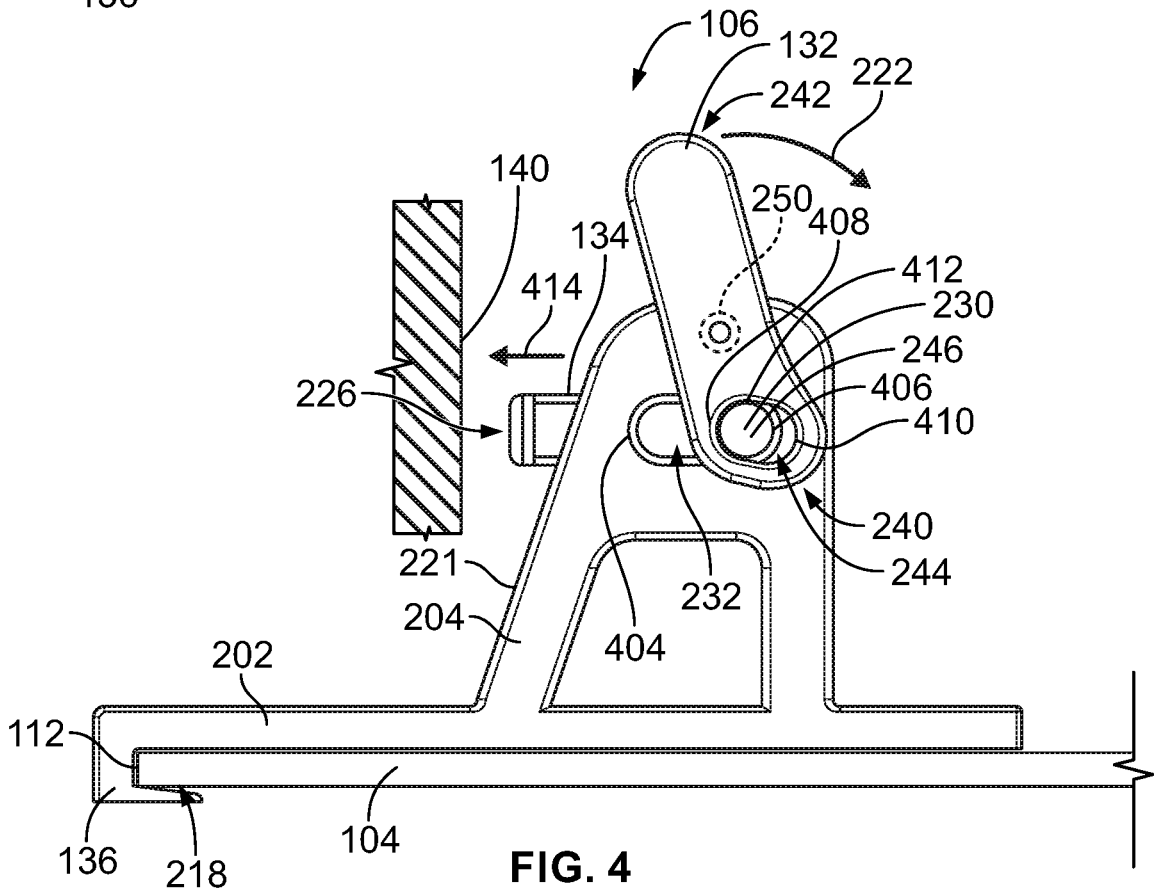
FIG. 4 shows a side view of the positioning apparatus in a first operative state according to an embodiment of the present disclosure.
Figure 5:
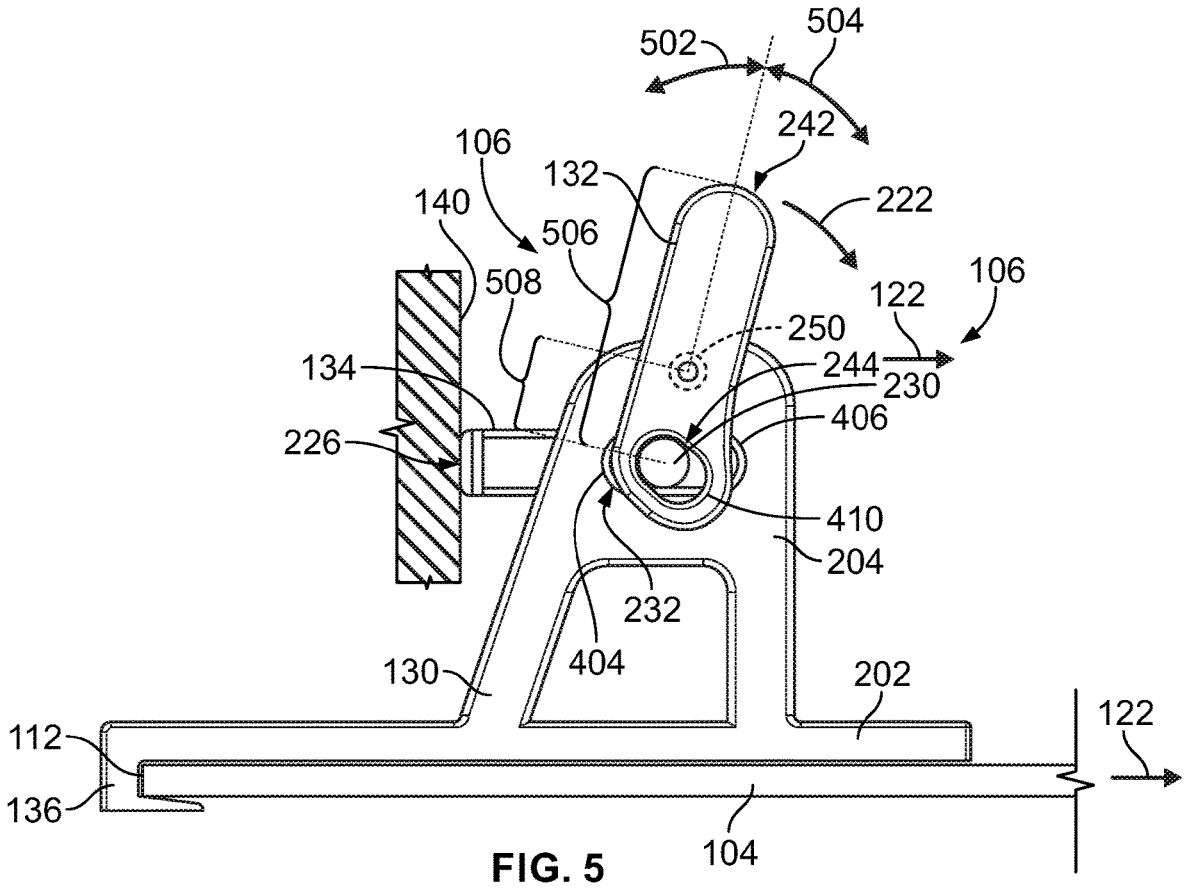
FIG. 5 shows a side view of the positioning apparatus in a second operative state according to an embodiment of the present disclosure.
Figure 6:
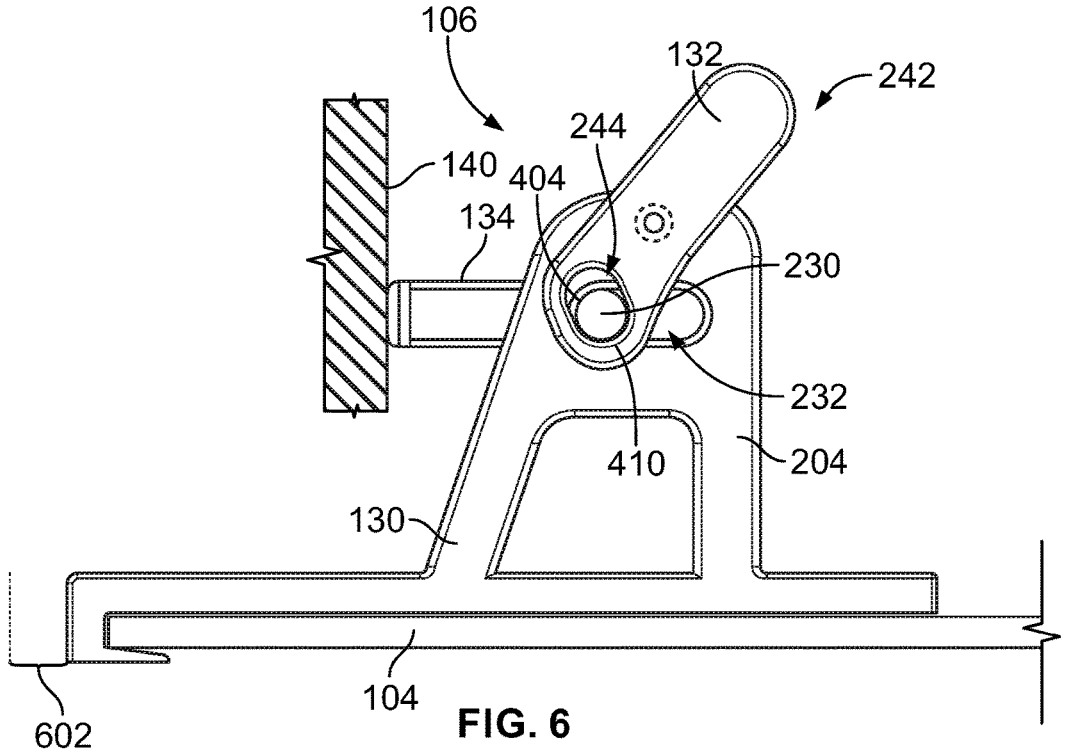
FIG. 6 shows a side view of the positioning apparatus in a third operative state according to an embodiment of the present disclosure.

FIGS. 4-6 show side views of the positioning apparatus 106 according to an embodiment of the present disclosure at different operative states when using the positioning apparatus 106 to adjust the position of the work piece 104 relative to the forming machine 102 (shown in FIG. 1).

FIG. 4 shows the positioning apparatus 106 in a first operative state. Prior to moving the work piece 104, the positioning apparatus 106 is placed on the work piece 104 such that the stand 202 sits on the work piece 104 and the edge 112 of the work piece 104 extends into the channel 218 of the claw portion 136. The pusher rod 134 is in a retracted position within the frame 204. The distal end 226 of the pusher rod 134 is spaced apart from the contact surface 140 of the forming machine 102 (FIG. 1). The contact surface 140 is shown generically in FIGS. 4-6.

The end segment 246 of the clevis pin 230 extends through both the first slot 232 in the frame 204 and the oblong opening 244 in the handle 132. Although not shown, the opposite side of the positioning apparatus 106 may mirror the visible side such that an opposite end segment 246 of the clevis pin 230 extends through both the second slot 234 in the frame 204 and the other oblong opening 244 in the handle 132. The description below only refers to the visible components of the positioning apparatus 106, but it is understood that the description also applies to the mirrored components on the other side of the positioning apparatus 106 that are not visible.

The slot 232 extends generally linearly (e.g., along the extension axis 224 shown in FIG. 3) between a front end 404 and a back end 406. The front end 404 is located closer to the front side 221 of the frame 204 than the back end 406, such that the front end 404 of the slot 232 is disposed between the front side 221 and the back end 406. When the pusher rod 134 is in the retracted position, the clevis pin 230 is disposed at or proximate to the back end 406 of the slot 232. The oblong opening 244 has a first end 408 and a second end 410. The clevis pin 230 is disposed at or proximate to the first end 408 of the oblong opening 244 in FIG. 4.

In the first operative state of the positioning apparatus 106, the handle 132 is in a starting position relative to the frame 204. When an input force is applied on the contact end 242 of the handle 132 in the actuation direction 222, such as by the hand of an operator that pulls on the bar 256 (FIG. 2), the handle 132 initially pivots or rotates about the pivot axle 250 (shown in phantom in FIG. 4-6). The clevis end 240 of the handle 132 swings towards the contact surface 140. Edges 412 of the oblong opening 244 of the handle 132 force the clevis pin 230 to move towards the front end 404 of the slot 232. The movement of the clevis pin 230 translates the pusher rod 134 outward toward the contact surface 140 in a forward direction 414 until the distal end 226 of the pusher rod 134 engages the contact surface 140.

FIG. 5 shows the positioning apparatus 106 in a second operative state in which the pusher rod 134 engages the contact surface 140 of the forming machine 102 (FIG. 1) prior to movement of the work piece 104. The second operative state is subsequent to the first operative state shown in FIG. 4. The handle 132 is in an intermediate position relative to the frame 204 in FIG. 5. In an embodiment, once the pusher rod 134 engages the contact surface 140, additional input force applied to the contact end 242 of the handle 132 in the actuation direction 222 causes the handle 132 to rotate about the clevis pin 230 during subsequent travel of the handle 132, instead of rotating further about the pivot axle 250.

For example, during travel of the contact end 242 of the handle 132 along a first arc length 502 from the starting position of the handle 132 (shown in FIG. 4) to the illustrated intermediate position in FIG. 5, the handle 132 pivots about the pivot axle 250. As the handle 132 pivots about the pivot axle 250, the pusher rod 134 translates towards the contact surface 140, while the base 130 and the work piece 104 are stationary relative to the contact surface 140. Once the distal end 226 of the pusher rod 134 engages the contact surface 140 as shown in FIG. 5, when an input force is applied to move the contact end 242 of the handle 132 beyond the first arc length 502 along a second arc length 504, the pusher rod 134 remains in contact with the contact surface 140 and no longer moves relative to the contact surface 140. The clevis pin 230, coupled to the pusher rod 134, also remains in a fixed location. The handle 132 rotates about the clevis pin 230 along the second arc length 504.

As the handle 132 rotates about the clevis pin 230, the handle 132 exerts an output force on the frame 204 of the base 130 via the pivot axle 250. The output force moves the base 130, including the frame 204 and the stand 202, in the rearward direction 122 away from the contact surface 140 of the forming machine 102. Since the edge 112 of the work piece 104 is held within the claw portion 136 of the base 130, the work piece 104 is dragged with the base 130 in the rearward direction 122. Thus, as the handle 132 is pivoted along the second arc length 504, the base 130 and the work piece 104 are moved in the rearward direction 122 relative to the contact surface 140 of the forming machine 102, while the pusher rod 134 and clevis pin 230 are stationary relative to the contact surface 140.

In an embodiment, the engagement between the pusher rod 134 and the contact surface 140 is used by the positioning apparatus 106 for leverage to generate a mechanical advantage, such that the output force applied on the frame 204 via the pivot axle 250 may be greater than the input force applied on the contact end 242 of the handle 132 by the operator. For example, when the handle 132 is in the intermediate position shown in FIG. 5, applying the manual input force on the contact end 242 of the handle 132 (e.g., via the bar 256 shown in FIG. 2) in the actuation direction 222 establishes a torque or moment. The moment has a value proportional to the product of the input force in the actuation direction 222 and a first length 506 along the handle 132 from the clevis pin 230 (which is the pivot point) to the contact end 242 of the handle 132 (which is the location of the input force). The value of the moment is also equivalent to the product of the output force exerted on the frame 204 and a second length 508 along the handle 132 from the clevis pin 230 to the pivot axle 250. Thus, the output force exerted on the frame 204 is equivalent to the value of the moment divided by the second length 508. The first length 506 is longer than the second length 508. Since the second length 508 is shorter than the first length 506, the output force generated is greater than the input force applied by the operator. As a result, the positioning apparatus 106 provides a mechanical advantage because output work that is exerted on the work piece 104 is greater than the input work exerted by the operator on the handle 132.

In the illustrated embodiment, the first length 506 may be at least double the second length 508. Thus, the output force generated by the positioning apparatus 106 may be at least two times the input force applied by the operator. For example, the operator pulling on the contact end 242 of the handle 132 with 50 pounds of force would cause the positioning apparatus 106 to exert at least 100 pounds of force on the work piece 104 to move the work piece 104 relative to the forming machine 102 (FIG. 1).

When the handle 132 is in the intermediate position, the clevis pin 230 is spaced apart from each of the front and back ends 404, 406 of the slot 232. The clevis pin 230 is located closer to the front end 404 when the handle 132 is in the intermediate position relative to the handle 132 in the starting position (shown in FIG. 4). In addition, the pusher rod 134 projects farther from the frame 204 when the handle 132 is in the intermediate position relative to the handle 132 in the starting position. The clevis pin 230 is disposed at or proximate to the second end 410 of the oblong opening 244. For example, the larger size of the oblong opening 244 allows the clevis pin 230 to translate within the oblong opening 244 as the handle 132 rotates about the pivot axle 250.

FIG. 6 shows the positioning apparatus 106 in a third operative state in which the pusher rod 134 engages the contact surface 140 of the forming machine 102 (FIG. 1) and both the base 130 and work piece 104 have been moved away from the contact surface 140. For example, the base 130 and the work piece 104 have been moved a designated distance 602 relative to the location of the base 130 and work piece 104 in the first and second operative states shown in FIGS. 4 and 5. The designated distance 602 may be any distance based on the size of the positioning apparatus 106, such as, for example, 1 cm, 5 cm, 10 cm, 20 cm, or 50 cm.

The handle 132 is disposed in an end position that represents the farthest that the handle 132 can be pivoted in the actuation direction 222 (FIG. 5) relative to the starting position of the handle 132 shown in FIG. 4. The clevis pin 230 is disposed at the front end 404 of the slot 232 of the frame 204. The clevis pin 230 is located at the second end 410 of the oblong opening 244. The pusher rod 134 is located in a fully extended position that represents the farthest that the pusher rod 134 can project from the frame 204. For example, the distance that the pusher rod 134 extends from the frame 204 is limited by the position of the clevis pin 230 within the slot 232 of the frame 204. The engagement between the clevis pin 230 and the front end 404 of the slot 232 blocks any additional movement of the base 130 and the work piece 104 in the rearward direction 122 (FIG. 5) relative to the pusher rod 134 and the contact surface 140.

The positioning apparatus 106 may be used to move the work piece 104 distances less than the designated distance 602 by not moving the contact end 242 of the handle 132 fully to the end position. For example, an operator may stop pulling or pushing the handle 132 once the work piece 104 reaches a designated alignment position relative to the forming machine 102 (FIG. 1). After moving the work piece 104 to the designated alignment position, the operator may rotate the contact end 242 of the handle 132 towards the starting position, which retracts the pusher rod 134. Then, the operator may remove the positioning apparatus 106 from the work piece 104 before activating the forming machine 102 (FIG. 1) to form the work piece 104.

Figure 7:
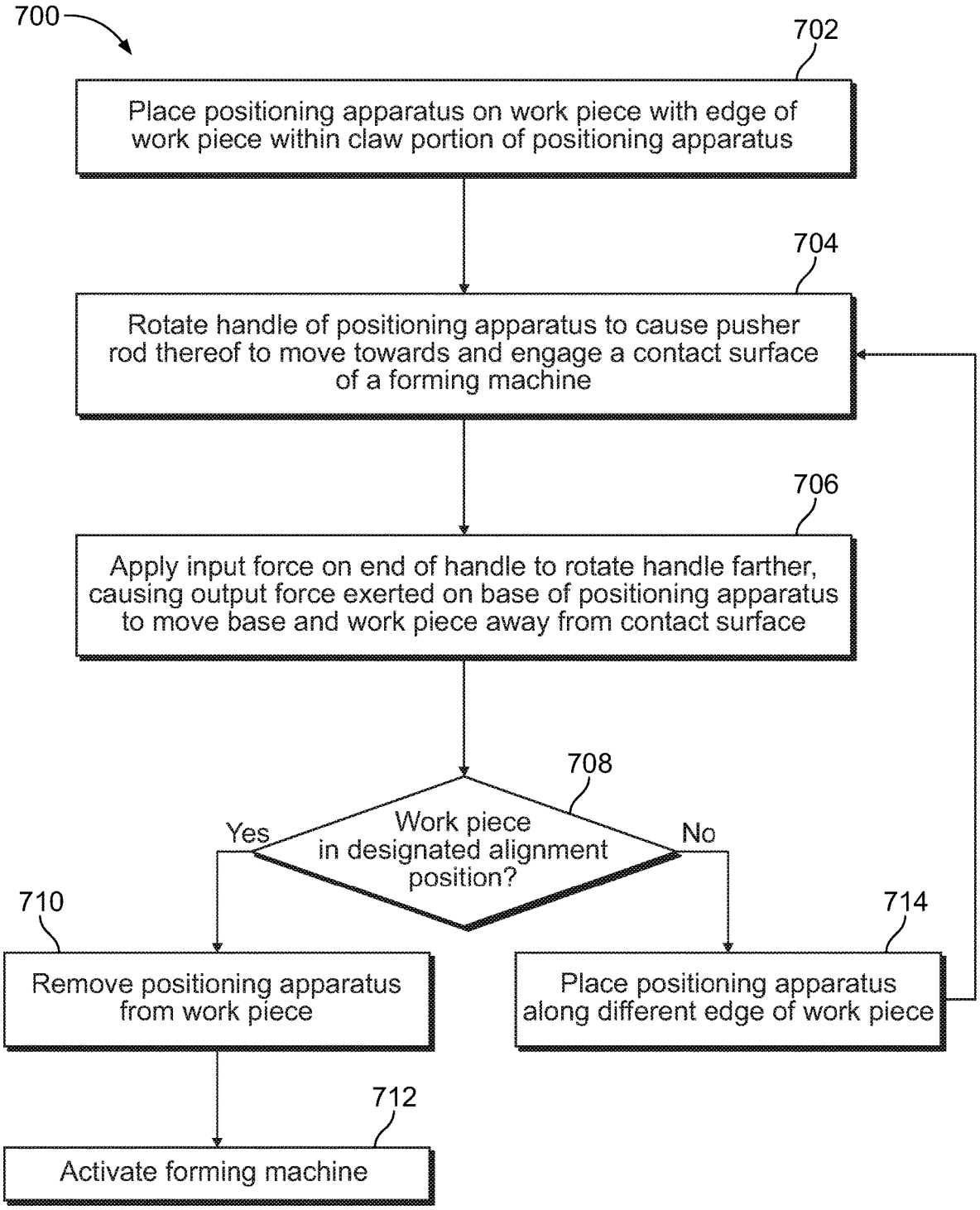
FIG. 7 is a flow chart of a method for aligning a work piece relative to a forming machine according to an embodiment of the present disclosure

FIG. 7 is a flow chart of a method 700 for aligning a work piece relative to a forming machine according to an embodiment of the present disclosure. The method 700 may be performed using the positioning apparatus 106 described herein with reference to FIGS. 1-6. At 702, the positioning apparatus 106 is placed on a work piece 104 that is disposed on a forming machine 102. The positioning apparatus 106 is oriented on the work piece 104 such that an edge 112 of the work piece 104 is received within a claw portion 136 of a base 130 of the positioning apparatus 106. For example, an operator may slide the positioning apparatus 106 relative to the work piece 104 to receive the edge 112 of the work piece 104 into a channel 218 of the claw portion 136.

At 704, a handle 132 of the positioning apparatus 106 is rotated relative to the base 130 to cause a pusher rod 134 of the positioning apparatus 106 to move outward from the base 130 towards a contact surface 140 of a forming machine 102. A contact end 242 of the handle 132 is rotated along a first arc length 502. The pusher rod 134 moves from the base 130 until a distal end 226 of the pusher rod 134 engages the contact surface 140. The handle 132 is pivotally coupled to the base 130 via a pivot axle 250. The handle 132 rotates about the pivot axle 250 along the first arc length 502. The handle 132 has a clevis end 240 mechanically coupled to the pusher rod 134 via a clevis pin 230 that is spaced apart from the pivot axle 250. The pivot axle 250 is located at an intermediate section 252 of the handle 132 between the clevis end 240 and the contact end 242.

At 706, an input force is applied on the contact end 242 of the handle 132 to rotate the handle 132 farther (e.g., beyond the first arc length 502 along an adjacent, second arc length 504). The input force may be applied manually by an operator. The input force causes the handle 132 to rotate about the clevis pin 230, as opposed to the pivot axle 250. The rotation of the handle 132 about the clevis pin 230 produces an output force that is exerted on the base 130 via the pivot axle 250. The output force moves the base 130 in a rearward direction 122 away from the contact surface 140 of the forming machine 102. As the base 130 moves, the work piece 104 is moved with the base 130 via the engagement with the claw portion 136 of the base 130.

At 708, a determination is made whether the work piece 104 is in a designated alignment position, which represents a position that is properly aligned with the forming machine 102. If, after the positioning apparatus 106 moves the work piece 104 in the rearward direction 122, the work piece 104 is in the designated alignment position, then flow proceeds to 710. At 710, the positioning apparatus 106 is removed from the work piece 104. Then, at 712, the forming machine 102 is activated to form the work piece 104.

Referring now back to 708, if the work piece 104 is not in the designated alignment position after the positioning apparatus 106 moves the work piece 104, then flow proceeds to 714. At 714, the positioning apparatus 106 is placed on the work piece 104 along a different edge of the work piece 104. Flow subsequently returns to 704 for rotating the handle 132 to extend the pusher rod 134 towards another contact surface of the forming machine 102. This positioning cycle (e.g., steps 704, 706, and 714) may repeat until the work piece 104 properly aligns with the forming machine 102 and the flow continues to steps 710 and 712 to form the work piece 104.

Figure 8:
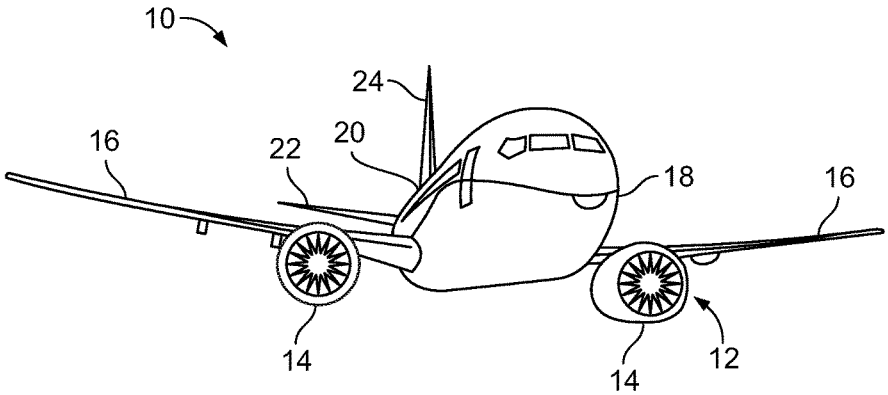
FIG. 8 illustrates a front perspective view of an aircraft according to an embodiment of the present disclosure.

FIG. 8 illustrates a front perspective view of an aircraft 10 according to an embodiment of the present disclosure. The aircraft 10 shown in FIG. 8 may be a commercial aircraft. The aircraft 10 in the illustrated embodiment includes a propulsion system 12 with two main engines 14 for propelling the aircraft 10. The main engines 14 may be gas turbine engines. Optionally, the propulsion system 12 may include more main engines 14 than shown. The main engines 14 may be carried by wings 16 of the aircraft 10. In other embodiments, the main engines 14 may be carried by a fuselage 18 and/or an empennage 20. The empennage 20 includes horizontal stabilizers 22 (although only one is visible in FIG. 8) and a vertical stabilizer 24. The fuselage 18 of the aircraft 10 may define interior compartments or areas, such as a passenger cabin, a flight deck, a cargo area, and/or the like. In at least one embodiment, the manufacturing system 100 shown in FIG. 1 may be used to form components of the aircraft 10. For example, the forming machine 102 may be used to form the work piece 104 into a structural member, such as a spar, that is assembled into one of the wings 16, one of the horizontal stabilizers 22, or the vertical stabilizer 24 of the aircraft 10. The positioning apparatus 106 may be used to align the work piece 104 with the forming machine 102 such that the spar (or other component) that is formed meets part requirements and specifications for use within the aircraft 10. As described above, aligning work pieces with machines that form spars or other aircraft parts for aircraft manufacturing is only one possible application of the positioning apparatus 106, such that the positioning apparatus 106 may also be used to align work pieces with other types of machines for other applications.

As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are example embodiments. Many other embodiments will be apparent to those of ordinary skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A positioning apparatus for aligning a work piece with a forming machine, the positioning apparatus comprising:

a base including a stand and a frame that extends from the stand, the stand having a claw portion configured to receive an edge of the work piece, the frame defining an aperture;

a pusher rod protruding through the aperture of the frame, the pusher rod having a proximal end within the frame and a distal end outside of the frame;

a clevis pin mechanically coupled to the proximal end of the pusher rod, the clevis pin having a first end segment and a second end segment that extend through corresponding first and second slots within the frame; and a handle having a clevis end and a contact end opposite the clevis end, the clevis end mechanically coupled to the clevis pin and pivotable relative to the clevis pin, the handle pivotally coupled to the frame via a pivot axle that is spaced apart from the clevis pin, wherein the handle defines two oblong openings at the clevis end, each of the oblong openings receiving a corresponding one of the first and second end segments of the clevis pin, the oblong openings having larger sizes than the first and second end segments to allow the first and second end segments to translate within the oblong openings as the handle rotates about the pivot axle, and wherein, when the handle is rotated about the pivot axle such that the distal end of the pusher rod extends and engages a contact surface of the forming machine, an input force applied to the contact end of the handle causes rotation of the handle about the clevis pin and exertion of an output force on the frame via the pivot axle, the output force moving the base and the work piece within the claw portion in a rearward direction away from the contact surface.

2. The positioning apparatus of claim 1, wherein the pivot axle is located at an intermediate section of the handle between the clevis end and the contact end.

3. The positioning apparatus of claim 2, wherein a first length from the clevis pin to the contact end of the handle is at least double a second length from the clevis pin to the pivot axle, such that the output force applied on the frame via the pivot axle is at least double the magnitude of the input force applied to the contact end of the handle to provide a mechanical advantage.

4. The positioning apparatus of claim 1, wherein the pusher rod is translatable relative to the frame along an extension axis that is disposed above the stand and is generally parallel to a bottom side of the stand that is configured to engage the work piece.

5. The positioning apparatus of claim 1, wherein the stand has a top side and a bottom side that is opposite the top side, the frame extending from the top side, the claw portion projecting from the bottom side and having a hook end, wherein the bottom side of the stand engages the work piece and the edge of the work piece is received within a channel defined between the bottom side and the hook end.

6. The positioning apparatus of claim 1, wherein the pusher rod is translatable relative to the frame through the aperture as the handle rotates, wherein a distance that the pusher rod moves relative to the frame is limited by respective positions of the first and second end segments of the clevis pin within the corresponding first and second slots of the frame.

7. The positioning apparatus of claim 1, wherein, during initial rotation of the handle about the pivot axle before the pusher rod engages the contact surface of the forming machine, the pusher rod moves towards the contact surface and the base is stationary relative to the forming machine, and, wherein, during subsequent rotation of the handle about the clevis pin while the pusher rod engages the contact surface, the pusher rod is stationary relative to the forming machine and the base and the work piece move relative to the forming machine in the rearward direction.

8. The positioning apparatus of claim 1, wherein the pusher rod is integral with the clevis pin such that the pusher rod and the clevis pin define a unitary, monolithic structure.

9. The positioning apparatus of claim 1, wherein the frame is integral with the stand such that the base is a unitary, monolithic structure.

10. The positioning apparatus of claim 1, wherein the handle includes two arms that each extend from the clevis end to the contact end and a bar that extends between and couples to the two arms at the contact end, the pivot axle defined by one or more posts of the handle that extend from the arms through holes in the frame.

11. The positioning apparatus of claim 1, wherein the aperture of the frame has a depth that extends from an exterior surface of the frame to an interior surface of the frame, the frame including interior walls that define a perimeter of the aperture along the depth of the aperture, wherein one or more of the interior walls engage and guide the movement of the pusher rod relative to the frame as the handle is rotated.

12. A positioning apparatus for aligning a work piece with a forming machine, the positioning apparatus comprising:

a base having a claw portion configured to receive an edge of the work piece;

a pusher rod held on the base and translatable relative to the base along an extension axis that is spaced apart from the claw portion of the base; and a handle having a clevis end and a contact end opposite the clevis end, the clevis end mechanically coupled to the pusher rod via a clevis pin, the handle pivotally coupled to the base via a pivot axle that is spaced apart from the clevis pin, wherein the clevis pin has a first end segment and a second end segment, the handle defining two oblong openings at the clevis end, each of the oblong openings receiving a corresponding one of the first and second end segments of the clevis pin, the oblong openings having larger sizes than the first and second end segments to allow the first and second end segments to translate within the oblong openings as the handle rotates about the pivot axle, and wherein, when a distal end of the pusher rod engages a contact surface of the forming machine, an input force applied to the contact end of the handle causes rotation of the handle about the clevis pin and exertion of an output force on the base via the pivot axle, wherein the output force on the base moves the claw portion and the work piece therein in a rearward direction away from the contact surface to align the work piece relative to the forming machine.

13. The positioning apparatus of claim 12, wherein the base includes a stand and a frame that extends from the stand, the frame holding the pusher rod a spaced apart distance above the stand, the stand defining the claw portion.

14. The positioning apparatus of claim 12, wherein the pivot axle is located at an intermediate section of the handle between the clevis end and the contact end, and a first length along the handle from the clevis pin to the contact end of the handle is at least double a second length along the handle from the clevis pin to the pivot axle.

15. The positioning apparatus of claim 12, wherein, during initial rotation of the handle about the pivot axle before the pusher rod engages the contact surface of the forming machine, the pusher rod moves towards the contact surface and the base is stationary relative to the forming machine, and, wherein, during subsequent rotation of the handle about the clevis pin while the pusher rod engages the contact surface, the pusher rod is stationary relative to the forming machine and the base and the work piece move relative to the forming machine in the rearward direction.

16. A method for aligning a work piece relative to a forming machine, the method comprising:

placing a positioning apparatus on the work piece that is disposed on the forming machine such that an edge of the work piece is received within a claw portion of a base of the positioning apparatus;

rotating a handle of the positioning apparatus along a first arc length to cause a pusher rod of the positioning apparatus to move relative to the base towards a contact surface of the forming machine until a distal end of the pusher rod engages the contact surface, the handle being pivotally coupled to the base via a pivot axle and rotating about the pivot axle along the first arc length, the handle having a clevis end mechanically coupled to the pusher rod via a clevis pin that is spaced apart from the pivot axle, wherein the handle defines two oblong openings at the clevis end, each of the oblong openings receiving a corresponding one of first and second end segments of the clevis pin, the oblong openings having larger sizes than the first and second end segments to allow the first and second end segments to translate within the oblong openings as the handle rotates about the pivot axle; and applying an input force to rotate the handle beyond the first arc length causing the handle to rotate about the clevis pin and an output force to be exerted on the base via the pivot axle, the output force moving the base and the work piece within the claw portion in a rearward direction away from the contact surface of the forming machine.

17. The method of claim 16, wherein the base of the positioning apparatus includes a stand and a frame extending from a top side of the stand, wherein the claw portion of the base extends from a bottom side of the stand and has a hook end, the claw portion defining a channel between the hook end and the bottom side of the stand such that placing the positioning apparatus on the work piece involves sliding the positioning apparatus relative to the work piece to receive the edge of the work piece within the channel.

18. The method of claim 16, wherein the input force is applied to a contact end of the handle that is opposite the clevis end, wherein the pivot axle is located at an intermediate section of the handle between the clevis end and the contact end.

19. The method of claim 16, wherein the handle includes two arms that each extend from the clevis end to a contact end of the handle and a bar that extends between and couples to the two arms at the contact end, the pivot axle defined by one or more posts of the handle that extend from the arms through holes in the frame.

20. A positioning apparatus for aligning a work piece with a forming machine, the positioning apparatus comprising:

a base including a stand and a frame that extends from the stand, the stand having a claw portion configured to receive an edge of the work piece, the frame defining an aperture;

a pusher rod protruding through the aperture of the frame, the pusher rod having a proximal end within the frame and a distal end outside of the frame;

a clevis pin mechanically coupled to the proximal end of the pusher rod, the clevis pin having a first end segment and a second end segment that extend through corresponding first and second slots within the frame; and a handle having a clevis end and a contact end opposite the clevis end, the clevis end mechanically coupled to the clevis pin and pivotable relative to the clevis pin, the handle pivotally coupled to the frame via a pivot axle that is spaced apart from the clevis pin, wherein the handle includes two arms that each extend from the clevis end to the contact end and a bar that extends between and couples to the two arms at the contact end, the pivot axle defined by one or more posts of the handle that extend from the arms through holes in the frame, and wherein, when the handle is rotated about the pivot axle such that the distal end of the pusher rod extends and engages a contact surface of the forming machine, an input force applied to the contact end of the handle causes rotation of the handle about the clevis pin and exertion of an output force on the frame via the pivot axle, the output force moving the base and the work piece within the claw portion in a rearward direction away from the contact surface.

21. A method for aligning a work piece relative to a forming machine, the method comprising:

placing a positioning apparatus on the work piece that is disposed on the forming machine such that an edge of the work piece is received within a claw portion of a base of the positioning apparatus;

rotating a handle of the positioning apparatus along a first arc length to cause a pusher rod of the positioning apparatus to move relative to the base towards a contact surface of the forming machine until a distal end of the pusher rod engages the contact surface, the handle being pivotally coupled to the base via a pivot axle and rotating about the pivot axle along the first arc length, the handle having a clevis end mechanically coupled to the pusher rod via a clevis pin that is spaced apart from the pivot axle, wherein the handle includes two arms that each extend from the clevis end to a contact end of the handle and a bar that extends between and couples to the two arms at the contact end, the pivot axle defined by one or more posts of the handle that extend from the arms through holes in the frame; and applying an input force to rotate the handle beyond the first arc length causing the handle to rotate about the clevis pin and an output force to be exerted on the base via the pivot axle, the output force moving the base and the work piece within the claw portion in a rearward direction away from the contact surface of the forming machine.

* * * * *